US009196443B2

(12) United States Patent
Ward

(10) Patent No.: US 9,196,443 B2
(45) Date of Patent: Nov. 24, 2015

(54) AIR CIRCUIT BREAKER COIL ADAPTER

(71) Applicant: P.S. Electrical Services (1998) Limited, Hartlebury Kidderminster, Worcestershire (GB)

(72) Inventor: Peter Ward, Hartlebury Kidderminster (GB)

(73) Assignee: P.S. Electrical Services (1998) Limited, Worcestershire (GB)

( * ) Notice: Subject to any disclaimer, the term of this patent is extended or adjusted under 35 U.S.C. 154(b) by 0 days.

(21) Appl. No.: 14/369,198

(22) PCT Filed: Jan. 15, 2013

(86) PCT No.: PCT/GB2013/050075
§ 371 (c)(1),
(2) Date: Jun. 27, 2014

(87) PCT Pub. No.: WO2013/114073
PCT Pub. Date: Aug. 8, 2013

(65) Prior Publication Data

US 2014/0347149 A1 Nov. 27, 2014

(30) Foreign Application Priority Data

Jan. 30, 2012 (GB) ..... 1201545.9

(51) Int. Cl.
*H01H 71/02* (2006.01)
*H01H 31/02* (2006.01)
(Continued)

(52) U.S. Cl.
CPC ..... *H01H 71/0228* (2013.01); *H01H 3/38* (2013.01); *H01H 31/02* (2013.01); *H01H 31/04* (2013.01);
(Continued)

(58) Field of Classification Search
CPC ..... H01H 51/00; H01H 67/02; H01H 77/10; H01H 9/02; H01H 3/42
USPC ..... 335/185
See application file for complete search history.

(56) References Cited

U.S. PATENT DOCUMENTS 4,801,910 A 1/1989 Ayers et al.
5,182,461 A * 1/1993 Baran ..... 307/41
(Continued)

FOREIGN PATENT DOCUMENTS

EP W02006105881 A1 10/2006
FR 2412160 A 7/1979
(Continued)

OTHER PUBLICATIONS

International Search Report of International application No. PCT/GB2013/050075 completed May 7, 2013 and mailed May 16, 2013 (4 pages).
(Continued)

*Primary Examiner* — Shawki S Ismail
*Assistant Examiner* — Lisa Homza
(74) *Attorney, Agent, or Firm* — Pyprus Pte Ltd

(57) ABSTRACT

Air circuit breaker coil adapter for adapting an air circuit breaker, comprises: a coil unit housing for releasably receiving an air circuit breaker coil unit, the coil unit housing having a coil retainer element for preventing or limiting upward movement of an air circuit breaker coil unit therein; a locator at a bottom end of the coil unit housing for positively locating the coil unit housing in a plunger aperture of an air circuit breaker housing, the locator having a plunger aperture therethrough by which an interior of the coil unit housing is in-use communicable with an interior of the air circuit breaker housing; and a housing retainer element for at least in part preventing or limiting vertical displacement of the coil unit housing. An air circuit breaker using such an adapter and a method of adapting an air circuit breaker are also provided.

10 Claims, 4 Drawing Sheets

(51) Int. Cl.
*H01H 71/24* (2006.01)
*H01H 3/38* (2006.01)
*H01H 31/04* (2006.01)

(52) U.S. Cl.
CPC ..... *H01H 71/2481* (2013.01); *H01H 2221/066* (2013.01); *H01H 2223/00* (2013.01); *Y10T 29/4902* (2015.01)

(56) References Cited

U.S. PATENT DOCUMENTS

| | | | | |
|---|---|---|---|---|
| 5,241,290 | A * | 8/1993 | Sehmer et al. | 335/202 |
| 5,300,908 | A | 4/1994 | Stone et al. | |
| 5,874,877 | A * | 2/1999 | Kawashima et al. | 335/132 |
| 5,894,257 | A * | 4/1999 | Roger et al. | 335/172 |
| 6,255,924 | B1 * | 7/2001 | Turner et al. | 335/157 |
| 6,337,449 | B1 * | 1/2002 | Brouillat et al. | 200/400 |
| 6,348,847 | B1 * | 2/2002 | Nakajima et al. | 335/195 |
| 6,414,575 | B1 * | 7/2002 | Swift | 335/6 |
| 6,975,191 | B2 * | 12/2005 | Ward | 335/18 |
| 7,911,303 | B2 * | 3/2011 | Morita et al. | 335/174 |
| 7,986,203 | B2 * | 7/2011 | Watford | 335/10 |
| 8,049,584 | B2 * | 11/2011 | Mueller et al. | 335/176 |
| 8,525,624 | B2 * | 9/2013 | Rosch et al. | 335/172 |
| 8,766,749 | B2 * | 7/2014 | Ganley et al. | 335/173 |
| 2003/0210114 | A1 * | 11/2003 | Brandon et al. | 335/21 |
| 2006/0071742 | A1 * | 4/2006 | Castonguay et al. | 335/20 |
| 2006/0132270 | A1 * | 6/2006 | Turner et al. | 335/132 |
| 2006/0250200 | A1 * | 11/2006 | Babu et al. | 335/6 |
| 2008/0247123 | A1 | 10/2008 | Ulinskas | |
| 2009/0237190 | A1 * | 9/2009 | Nyzner | 335/174 |
| 2010/0164658 | A1 * | 7/2010 | Woo | 335/21 |

FOREIGN PATENT DOCUMENTS

| | | | |
|---|---|---|---|
| GB | 1451406 | A | 10/1976 |
| KR | 20100042973 | A | 4/2010 |
| KR | 20100052326 | A | 5/2010 |

OTHER PUBLICATIONS

Search Report of GB application No. GB1201545.9 (1 page).

* cited by examiner

AIR CIRCUIT BREAKER COIL ADAPTER

BACKGROUND OF THE INVENTION

The present invention relates to an air circuit breaker coil adapter for adapting an air circuit breaker, and to a method of adapting an air circuit breaker utilising a cylindrical or substantially cylindrical operating coil unit to a non-cylindrical operating coil unit.

An air circuit breaker is an electric circuit protection device which is installed between an electric source or supply and load units or devices to be operated. The breaker protects the load unit and a load line from an abnormal current generated on the electric circuit. The breaker also performs a distribution function for changing the electric power line to another line.

The electrical systems in residential, commercial and industrial applications usually include a panelboard for receiving electrical power from a utility source. The power is then routed through overcurrent protection devices to designated branch circuits supplying one or more loads. Electrical power distribution systems and their components require protection from numerous types of malfunctions, including overcurrent conditions, overvoltage conditions, undervoltage conditions, reverse current flow, and unbalanced phase voltages. These overcurrent devices are typically circuit interrupters such as circuit breakers and fuses which are designed to interrupt the electrical current if the limits of the conductors supplying the loads are surpassed and thus a malfunction condition is detected. Interruption of the circuit reduces the risk of injury or the potential of property damage from a resulting fire.

More elaborate time-current trip characteristics have been developed, such that a circuit breaker can rapidly open upon very high current with the time delay being roughly inversely proportional to the degree of overload. Circuit breakers are a preferred type of circuit interrupter, since a resetting mechanism allows their reuse. Circuit breakers can interrupt an electric circuit due to a trip condition such as a current overload or ground fault. The current overload condition results when a current exceeds the continuous rating of the breaker for a time interval determined by the trip current.

Circuit breakers are mechanical switching devices capable of making, carrying, and breaking currents under normal circuit conditions and also making, carrying for a specified time, and breaking currents under specified abnormal conditions such as those described above. Basically, a circuit breaker comprises a pair of separable contacts, an operating mechanism for effecting separation of the contacts, and a tripping mechanism which automatically releases the operating mechanism upon the occurrence of an overload or fault condition. The medium in which circuit interruption is performed may be designated by a suitable prefix, for example, air-blast circuit breaker, gas circuit breaker, oil circuit breaker, or vacuum circuit breaker. In operation, a circuit breaker is opened by energizing a trip coil associated with the circuit breaker. Once the trip coil is energized, the main contacts are opened and then auxiliary contacts are opened to prevent damage to the trip coil.

Circuit breakers may include an electronic trip unit that senses electrical current to the protected equipment. If the sensed electrical current indicates an overcurrent situation, the electronic trip unit provides a trip signal to a trip actuator. In response to the trip signal, the trip actuator actuates a mechanical operating mechanism. Actuation of the mechanical operating mechanism by the trip actuator causes the mechanical operating mechanism to separate the electrical contacts, stopping the flow of current to the protected equipment.

Air circuit breakers include operating mechanisms that are mainly exposed to the environment, hence the use of the term 'air'. Since an air circuit breaker is rated to carry several thousand amperes of current continuously, the exposure to convection cooling air assists in keeping the operating components within reasonable temperature limits.

A typical air circuit breaker comprises a component, module or unit for connecting an electrical power source to an electrical power consumer or load. The component may be referred to as a main contact assembly, and the main contact is typically either open, interrupting a path for power to travel from the source to the load, or closed, providing a path for power to travel from the source to the load.

In many air circuit breakers, the force necessary to open or close the main contact assembly is provided by an arrangement of compression springs, and the mechanism for controlling the compression springs comprises a configuration of mechanical linkages between a latching shaft and an actuation device. The actuation device may be manually or electrically operated. The current invention is for use with an air circuit breaker which utilises one or more, and typically three, electrically operable solenoid coil units as the said actuation devices.

Such air circuit breakers are critical for large scale power distribution systems, and in many cases it is not only cost-prohibitive to install an upgraded breaker system, but the down time for such a major removal and reinstallation program is unsupportable thereby making the process practically impossible.

Additionally, manufacturers are known to scale down factory support for existing air circuit breakers, forcing the consumer along the upgrade route or having the consumer wait unacceptably long periods for bespoke production of individual parts. New model components are typically not compatible with existing older model components, thus forcing the consumer to upgrade the entire breaker which in many cases is unacceptable as described above.

One of the main breakage areas and therefore replacement requirements of an air circuit breaker is the operating coil unit. In particular, the widely installed and now obsolete Merlin Gerin® Masterpact® M air circuit breaker utilises substantially cylindrical operating coil units. However, the newer NW model utilises physically incompatible substantially cuboid operating coil units. The present invention therefore seeks to provide a solution to at least part of this problem by providing an operating coil unit adapter.

BRIEF SUMMARY OF THE INVENTION

According to a first aspect of the invention, there is provided an air circuit breaker coil adapter for adapting an air circuit breaker, the coil adapter comprising a coil unit housing for releasably receiving an air circuit breaker coil unit, the coil unit housing having a coil retainer element for preventing or limiting upward movement of an air circuit breaker coil unit therein, a locator at a bottom end of the housing for positively locating the housing in an aperture of an air circuit breaker housing, the locator having a plunger aperture therethrough by which an interior of the coil unit housing is in use communicable with an interior of the air circuit breaker housing, and a housing retainer element for at least in part preventing or limiting vertical displacement of the coil unit housing when mounted on the air circuit breaker housing.

Preferable and/or optional features of the first aspect of the invention are set forth in claims 2 to 6, inclusive.

According to a second aspect of the invention, there is provided an air circuit breaker comprising an air circuit breaker housing and at least one operating coil unit, the said at least one operating coil unit being removably housable in an air circuit breaker coil adapter in accordance with the first aspect of the invention, the said coil adapter being removably engagable with a plunger aperture in an upper surface of the air circuit breaker housing and a locking head of an upstanding retainer post.

Preferable and/or optional features of the second aspect of the invention are set forth in claim 8 or claim 9.

According to a third aspect of the invention, there is provided a method of adapting an air circuit breaker utilising a cylindrical or substantially cylindrical operating coil unit to a non-cylindrical operating coil unit, the method comprising the steps of: a] housing a non-cylindrical operating coil unit in a coil unit housing of an air circuit breaker coil adapter; b] releasing a locking head of a retainer post upstanding from a top of the air circuit breaker housing; c] removing an unlocked cylindrical or substantially cylindrical operating coil unit from the air circuit breaker housing thereby exposing a plunger aperture; d] mounting the coil unit housing of the coil adapter with the non-cylindrical operating coil unit therein to the exposed plunger aperture; and e] reengaging the locking head of the said upstanding retainer post to lock the coil adapter with the non-cylindrical operating coil unit to the air circuit breaker housing.

BRIEF DESCRIPTION OF THE SEVERAL VIEWS OF THE DRAWINGS

The invention will now be more particularly described, by way of example only, with reference to the accompanying drawings, in which.

DETAILED DESCRIPTION OF THE INVENTION

Figure 1:
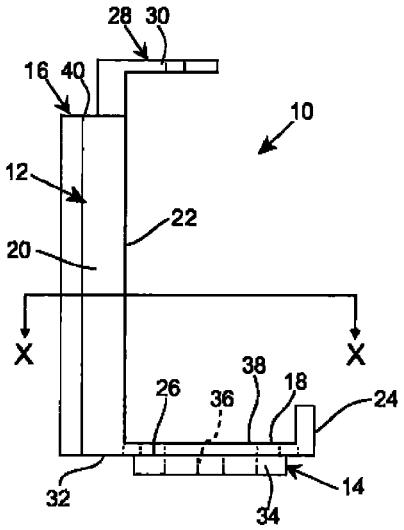
FIG. 1 is an orthogonal side view of one embodiment of an air circuit breaker coil adapter, in accordance with the first aspect of the invention.
Figure 2:
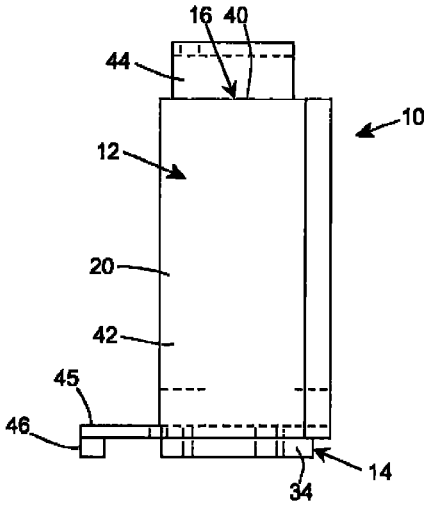
FIG. 2 is an orthogonal rear view of the coil adapter, shown in FIG. 1.
Figure 3:
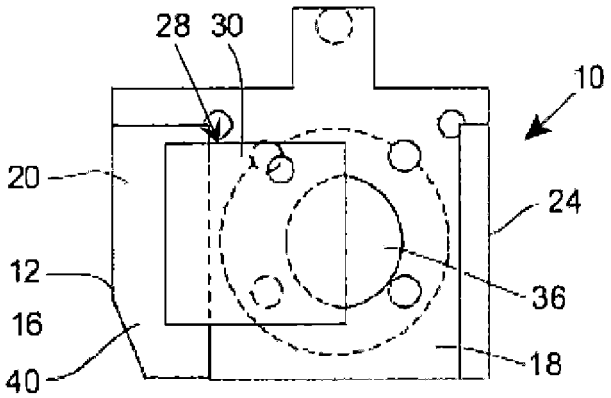
FIG. 3 is a top plan view of the coil adapter.
Figure 4:
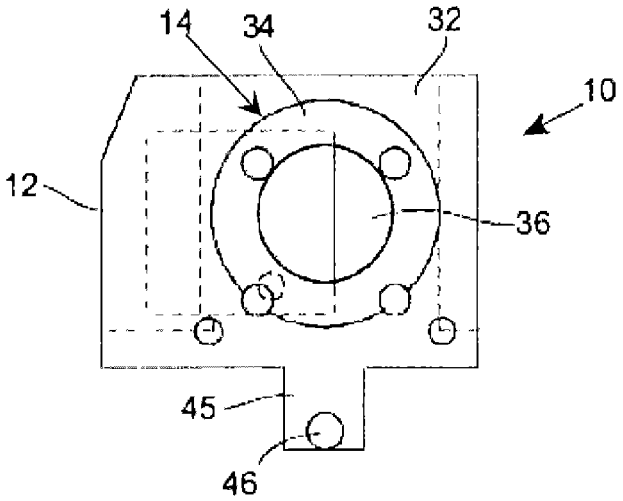
FIG. 4 is a bottom plan view of the coil adapter.
Figure 5:
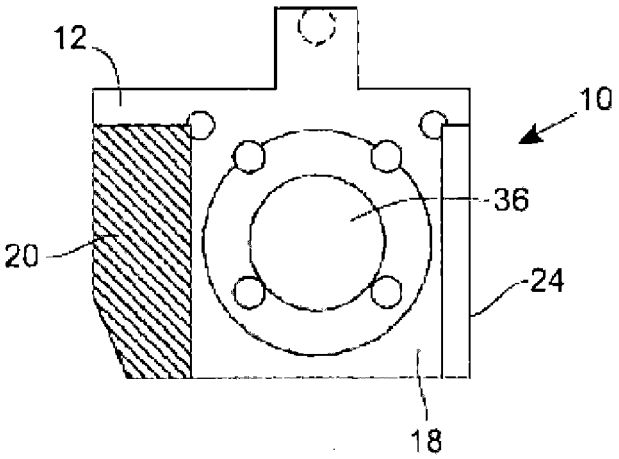
FIG. 5 is a lateral cross-sectional view taken along the line X-X in FIG. 1.

Referring to the drawings, there is shown an air circuit breaker coil adapter 10 which comprises a coil unit housing 12, a locator 14 at a bottom end of the coil unit housing 12, and a housing retainer element 16. The coil adapter 10 is preferably integrally formed as one-piece, for example, from moulded plastics such as glass-fibre nylon or ABS.

The coil unit housing 12 includes a planar or substantially planar base 18 and an upright back 20 which extends at or substantially at right angles to the base 18 contiguously from its rear edge. The back 20 is preferably unbroken and planar or substantially planar, at least on its inner surface 22. Together, the back 20 and the base 18 form an L-shape or substantially L-shape configuration.

An upstanding front lip 24 is preferably formed at a distal front edge of the base 18 remote from the back 20. In this case, the front lip 24 is a wall of uniform or substantially uniform thickness, extending continuously along the longitudinal extent of the front edge of the base 18 and in parallel with the back 20. Opposing openings 26 are thus defined between lateral ends of the front edge and opposing longitudinal edges of the back 20.

The coil unit housing 12 also includes a coil retainer element 28 which is preferably in the form of a cantilevered overhanging lip 30. The coil retainer element 28 is contiguous with an upper edge of the back 20 and projects perpendicularly or substantially perpendicularly outwardly at least partially over the base 18. Preferably, the coil retainer element 28 extends in parallel or substantially in parallel with the base 18, but has a lateral extent which is less than a front-to-back dimension of the base 18.

Due to the coil unit housing 12 being devoid of side walls, the overhanging lip 30 of the coil retainer element 28 is resiliently stiffly flexible, allowing a small amount of give and flex during insertion of an operating coil unit.

The locator 14 is provided on a lowermost surface 32 of the base 18 of the coil unit housing 12, and includes a downwardly projecting boss 34. The locator 14 also includes a plunger aperture 36 therethrough, a central axis of the plunger aperture 36 extending in parallel or substantially parallel with the back 20 of the coil unit housing 12.

The boss 34 and the plunger aperture 36 are preferably circular, and therefore the boss 34 forms a continuous ring. Although circular is convenient in terms of ease of manufacture, other non-circular shapes may however be envisaged, as necessity dictates.

The plunger aperture 36 extends from the locator 14 and breaks out on an upper surface 38 of the base 18.

The base 18 may also include one or more location holes on its upper surface 38 for releasably engaging complementarily shaped location pins on the base of an operating coil unit.

The housing retainer element 16, in this embodiment, is formed as a shoulder 40 adjacent to the top edge of the back 20 of the coil unit housing 12. A lower portion 42 of the back 20 from the lower edge at the base 18 to the shoulder 40 may be thicker than its upper portion 44 from the shoulder 40 to the top edge, in order to adequately withstand operating forces of the coil unit housed therein.

The housing retainer element 16 is adapted to be engagable with a locking head of an upstanding retainer post of an air circuit breaker, and as such has a sufficiently deep front-to-back lateral extent to enable sufficient overlap by the in use locking head.

The shoulder 40 in this case is formed as a step in the back surface of the back 20 of the coil unit housing 12. However, the housing retainer element 16 can be any suitable exterior ledge in the back surface of the back 20, and for example, may be provided by a slot, groove or channel adapted to accept the said locking head.

To prevent or limit in situ rotation of the coil unit housing 12, an outwardly projecting outrigger arm 45 at or adjacent to the base 18 of the coil unit housing 12 is preferably also included. The outrigger arm 45 is advantageously integrally formed as one-piece with the base 18 and extends to one side. The outrigger arm 45 includes a location element thereon, which in this case is a downwardly projecting peg or pin 46 complementarily shaped to engage with an opening in an upper surface of an air circuit breaker housing.

In use, a non-cylindrical operating coil unit 48 of an air circuit breaker 50 is mounted in the coil adapter 10. A housing 52 of the non-cylindrical operating coil unit 48 is inserted into the coil unit housing 12 either via one side or via the front and over the front lip 24. The overhanging lip 30 of the coil retainer element 28 is flexed backwards slightly to receive a top edge of the housing 52 of the non-cylindrical operating coil unit 48 thereunder. The non-cylindrical operating coil unit 48 is thus releasably and securely held by the coil unit adapter 10, with a plunger opening in a bottom surface of the housing 52 of the non-cylindrical operating coil unit 48 being aligned or substantially aligned with the plunger aperture 36 of the coil unit adapter 10.

With an obsolete cylindrical or substantially cylindrical operating coil unit removed from the top 53 of the air circuit breaker housing 54, the coil unit adapter 10 with the non-cylindrical operating coil unit 48 mounted therein is seated on the top of the air circuit breaker housing 54 so that the locator 14 is received in an exposed plunger aperture 55 in the upper surface 56 of the air circuit breaker housing 54. The coil unit adapter 10 is rotated until the pin 46 projecting downwardly from the outrigger arm 45 locates in its corresponding opening on the top of the air circuit breaker housing 54.

By provision of the coil retainer element 28, the non-cylindrical operating coil unit 48 held by the coil unit housing 12 is prevented or limited from vertical relative displacement. The locator 14 positively locates the coil unit housing 12 relative to the plunger aperture of the air circuit breaker housing 54, and the plunger aperture 36 of the locator 14 enables communication of the interior of the coil unit housing 12 with an interior of the air circuit breaker housing 54, whereby a plunger of the solenoid coil within the non-cylindrical operating coil unit 48 can travel at least in part from the non-cylindrical operating coil unit 48 into the air circuit breaker housing 54.

A locking head 58 on an upstanding retainer post 60 projecting upwardly from the top of the air circuit breaker housing 54 is then finally rotated to engage with the shoulder 40 of the housing retainer element 16. The coil adapter 10 with the non-cylindrical operating coil unit 48 held securely and stationary therein is thus positively and releasably engaged with the air circuit breaker housing 54.

Figure 6:
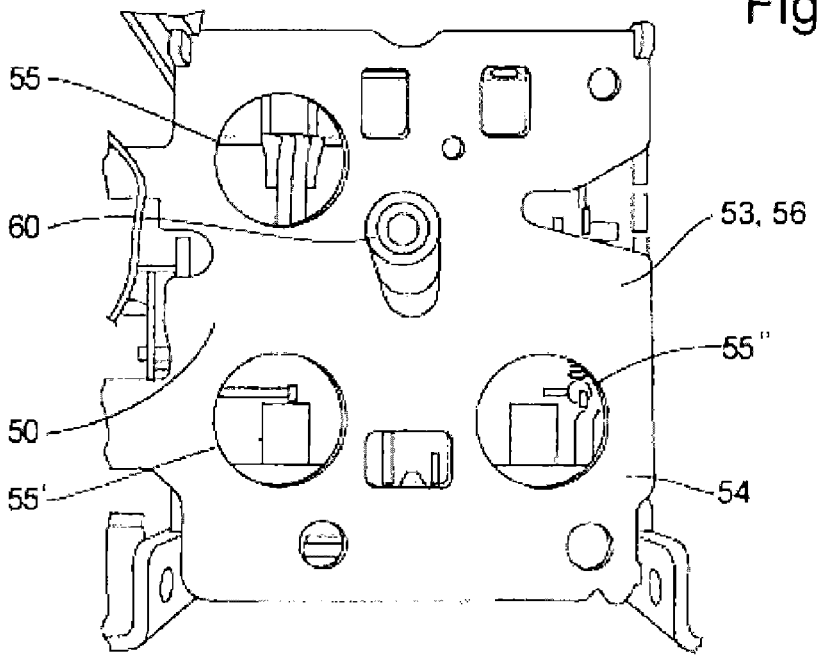
FIG. 6 shows a top plan view of a prior art air circuit breaker housing having substantially cylindrical operating coil units and a locking head removed.
Figure 7:
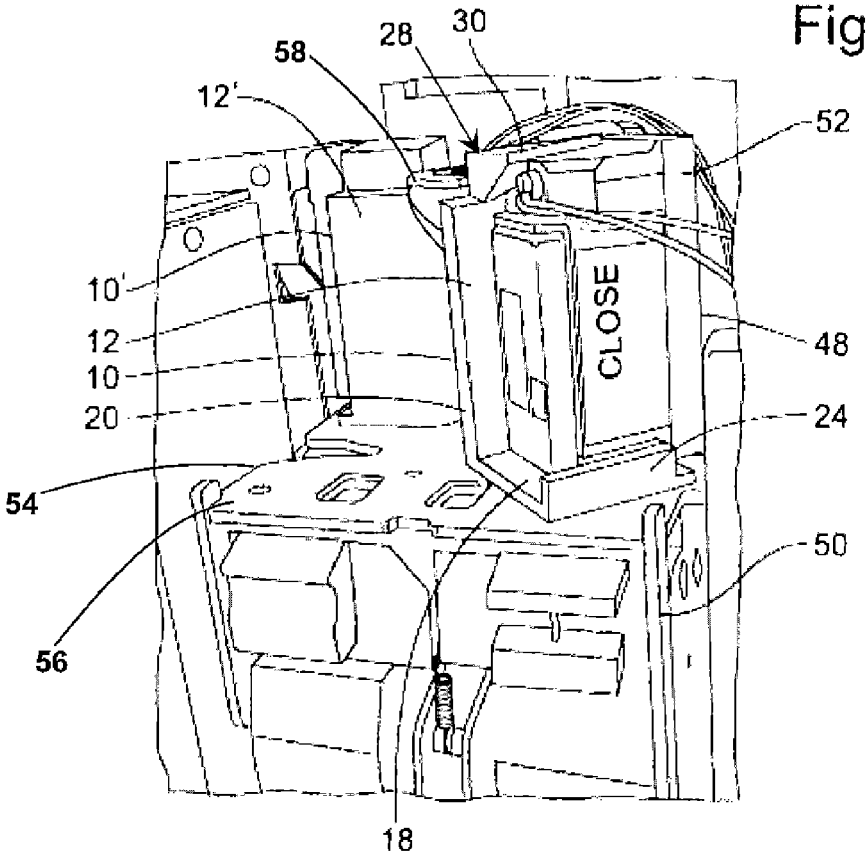
FIG. 7 is a first perspective view from the side of the in use air circuit breaker coil adapter mounted on an air circuit breaker housing as shown in FIG. 6 and housing a substantially cuboid operating coil unit, in accordance with the second aspect of the invention.
Figure 8:
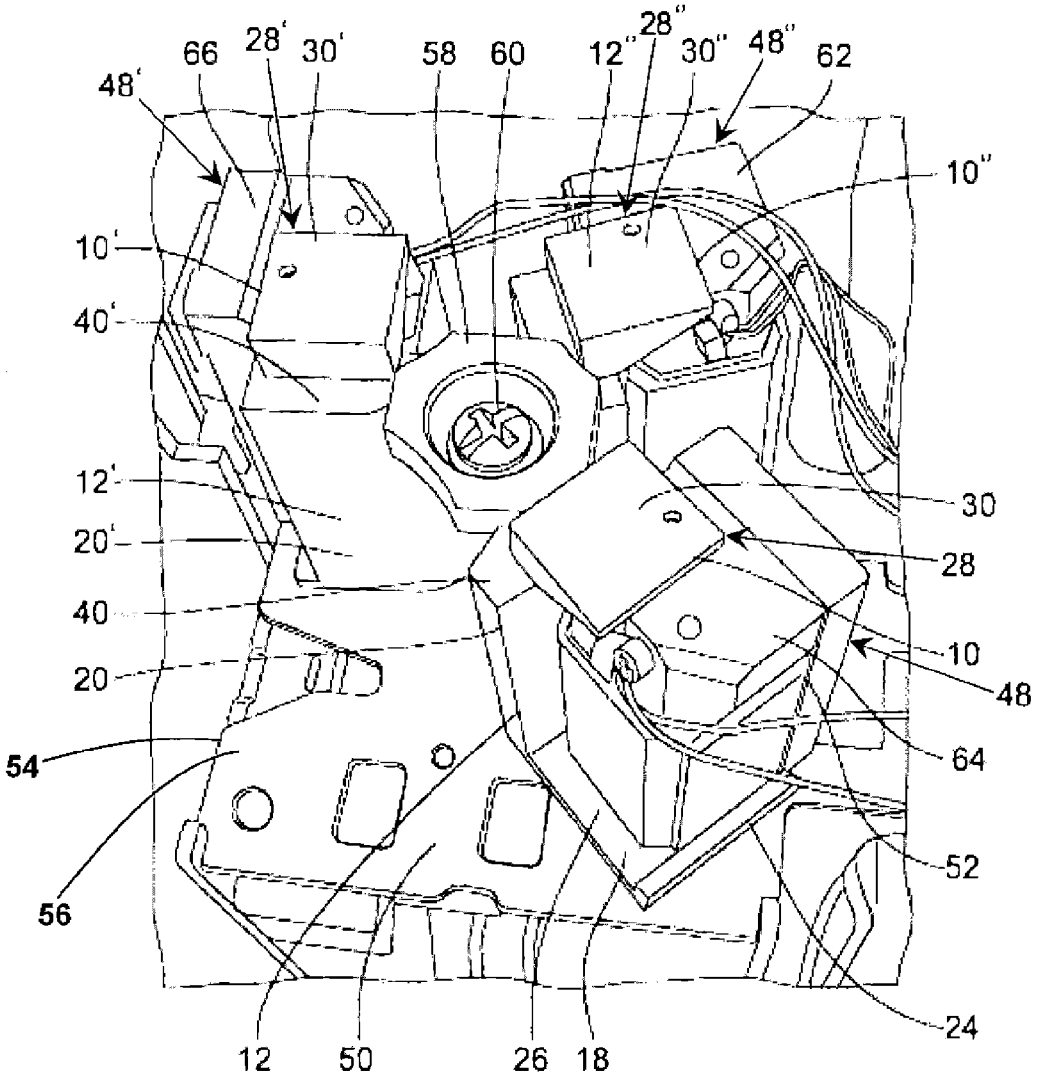
FIG. 8 is a second perspective view from above of the in use coil adapter as shown in FIG. 7.

In the case of the present invention, the air circuit breaker 50 includes three operating coil units, namely an open coil unit 62, a closed coil unit 64 and an under voltage release coil unit 66. Multiple identical components are identified in the drawings using reference numerals accompanied by inverted commas. However, for the avoidance of doubt, these components are the three plunger apertures 55, 55' and 55" in FIG. 6, the two visible coil adapters 10, 10' and corresponding coil unit housings 12, 12' in FIG. 7, and the three visible coil adapters 10, 10', 10", corresponding coil unit housings 12, 12', 12", coil retainer elements 28, 28', 28", overhanging lips 30, 30', 30" and non-cylindrical operating coil units 48, 48', 48". The air circuit breaker adapter 10, 10', 10" is suitable for all such non-cylindrical operating coil units 48, 48', 48", in this case being substantially cuboid. As such, all three obsolete cylindrical or substantially cylindrical operating coil units 48, 48', 48", can be removed and replaced by respective coil adapter 10, 10', 10" and required non-cylindrical operating coil unit 48, 48', 48", combinations.

It is thus possible to provide an air circuit breaker adapter for adapting an air circuit breaker by which an air circuit breaker utilising a cylindrical or substantially cylindrical operating coil unit is adapted to accept a non-cylindrical operating coil unit. The air circuit breaker adapter is cost-effective and prevents or limits the necessity of replacing an entire obsolete air circuit breaker to an upgraded system. The significant expense and the unsupportable downtime during the removal of the obsolete system and installation of the new system is thus dispensed with.

The embodiments described above are provided by way of examples only, and various other modifications will be apparent to persons skilled in the art without departing from the scope of the invention as defined by the appended claims.

What is claimed is:

1. An air circuit breaker coil adapter for adapting an air circuit breaker, the coil adapter comprising a coil unit housing which releasably receives an air circuit breaker coil unit, the coil unit housing having a coil retainer element which prevents or limits upward movement of an air circuit breaker coil unit therein, a locator at a bottom end of the housing which positively locates the housing in an aperture of an air circuit breaker housing, the locator having a plunger aperture therethrough by which an interior of the coil unit housing is in use communicable with an interior of the air circuit breaker housing, and a housing retainer element which at least in part prevents or limits vertical displacement of the coil unit housing when mounted on the air circuit breaker housing; wherein the locator is a circular boss; and further comprising an outwardly projecting arm at or adjacent to the base of the coil unit housing, the arm including a location element thereon, being a downwardly projecting peg;

Wherein the coil unit housing has an upright back and a laterally extending base whereby the coil unit housing forms or substantially forms an L-shape, an upstanding front lip at a distal front edge of the base and which is spaced from and parallel or substantially parallel with the back.

2. The air circuit breaker coil adapter as claimed in claim 1, wherein the coil unit housing is open at one side to enable side entry insertion of a said air circuit breaker coil unit.

3. The air circuit breaker coil adapter as claimed in claim 1, wherein the coil retainer element is at or adjacent to a top end of the coil unit housing.

4. The air circuit breaker coil adapter as claimed in 3, wherein the coil retainer element at least includes an overhanging lip.

5. The air circuit breaker coil adapter as claimed in claim 4, wherein the overhanging lip is resiliently flexible to enable an air circuit breaker coil unit to clip thereunder.

6. The air circuit breaker coil adapter as claimed in claim 1, wherein the housing retainer element is an exterior ledge engagable with a locking head of a retainer post of an air circuit breaker housing.

7. An Air circuit breaker comprising an air circuit breaker housing and at least one operating coil unit, the said at least one operating coil unit being removably housable in an air circuit breaker coil adapter as claimed in claim 1, the said coil adapter being removably engagable with a plunger aperture in an upper surface of the air circuit breaker housing and a locking head of an upstanding retainer post.

8. The air circuit breaker as claimed in claim 7, wherein the air circuit breaker housing includes three plunger apertures, a said coil adapter having an operating coil unit housed therein being engaged with each said plunger aperture, the locking head of the upstanding retainer post releasably engaging the three said coil adapters.

9. The air circuit breaker as claimed in claim 8, wherein the upstanding retainer post is centrally or substantially centrally provided relative to the three coil adapters.

10. A method of adapting an air circuit breaker utilising a cylindrical or substantially cylindrical operating coil unit to a non-cylindrical operating coil unit, the method comprising the steps of: a] housing a non-cylindrical operating coil unit in a coil unit housing of an air circuit breaker coil adapter as claimed in claim 1; b] releasing a locking head of a retainer post upstanding from a top of the air circuit breaker housing; c] removing an unlocked cylindrical or substantially cylindrical operating coil unit from the air circuit breaker housing thereby exposing a plunger aperture; d] mounting the coil unit housing of the coil adapter with the non-cylindrical operating coil unit therein to the exposed plunger aperture; and e] reengaging the locking head of the said upstanding retainer post to lock the coil adapter with the non-cylindrical operating coil unit to the air circuit breaker housing.

* * * * *